US006976321B1

(12) United States Patent
Lakic

(10) Patent No.: US 6,976,321 B1
(45) **Date of Patent: *Dec. 20, 2005**

(54) ADJUSTABLE AIR CUSHION INSOLE WITH ADDITIONAL UPPER CHAMBER

(76) Inventor: Nikola Lakic, 45-191 Elm St., Indio, CA (US) 92201

( * ) Notice: Subject to any disclaimer, the term of this patent is extended or adjusted under 35 U.S.C. 154(b) by 5 days.

This patent is subject to a terminal disclaimer.

(21) Appl. No.: 10/703,268

(22) Filed: Nov. 7, 2003

Related U.S. Application Data

(60) Provisional application No. 60/425,191, filed on Nov. 7, 2002.

(51) Int. Cl.[7] ..... A43B 13/38; A43B 13/20
(52) U.S. Cl. ..... 36/29; 36/44; 36/28; 36/3 B
(58) Field of Search ..... 36/43, 44, 29, 36/28, 3 R, 3 B, 88

(56) References Cited

U.S. PATENT DOCUMENTS

| | | | | |
|---|---|---|---|---|
| 1,213,941 A | | 1/1917 | Patrick | |
| 2,716,293 A | | 8/1955 | Rath | |
| 3,170,250 A | | 2/1965 | Scholl | |
| 3,180,039 A | | 4/1965 | Burns, Jr. | |
| 4,183,156 A | | 1/1980 | Rudy | |
| 4,271,606 A | | 6/1981 | Rudy | |
| 4,340,626 A | | 7/1982 | Rudy | |
| 4,730,403 A | | 3/1988 | Walkhoff | |
| 4,817,304 A | | 4/1989 | Parker et al. | |
| 4,864,737 A | * | 9/1989 | Marrello | 36/29 |
| 4,999,931 A | * | 3/1991 | Vermeulen | 36/29 |
| 5,025,575 A | | 6/1991 | Lakic | |
| 5,117,566 A | * | 6/1992 | Lloyd et al. | 36/29 |
| 5,287,638 A | | 2/1994 | Preston | |
| 5,846,063 A | | 12/1998 | Lakic | |
| 5,894,687 A | * | 4/1999 | Lin | 36/141 |
| 5,996,254 A | * | 12/1999 | Goven | 36/43 |
| 6,092,310 A | | 7/2000 | Schoesler | |
| 6,158,149 A | * | 12/2000 | Rudy | 36/29 |
| 6,178,663 B1 | * | 1/2001 | Schoesler | 36/43 |
| 6,510,624 B1 | * | 1/2003 | Lakic | 36/29 |
| 2001/0042321 A1 | * | 11/2001 | Tawney et al. | 36/29 |

FOREIGN PATENT DOCUMENTS

| | | | |
|---|---|---|---|
| DE | 2321817 | | 11/1973 |
| DE | 3144207 | | 5/1983 |
| GB | 357391 | | 9/1931 |
| GB | 2189679 | | 11/1987 |
| JP | 6-189806 | * | 6/1994 |

* cited by examiner

*Primary Examiner*—M. D. Patterson
(74) *Attorney, Agent, or Firm*—Schmeiser, Olsen & Watts LLP

(57) ABSTRACT

An inflatable inner sole for footwear has a flexible, inflatable enclosure with an inflation system that preferably includes an on-board air pump and a pressure relief valve. This embodiment has an additional upper chamber formed by heat sealing (welding) an outer layer of thermoplastic on top of an inflatable enclosure. The outer layer is preferably bonded only to the edges of the inflatable enclosures to permit free air/fluid flow from pressure points area to the area of least resistance and greatest need. Air pressure of the lower chamber can be adjusted according to a wearer's weight and activities. The upper chamber also has a built-in air pump and relief valve, preferably with lesser air pressure that can be adjusted according to the wearers foot problems or for final comfort tuning. The outer layer may be a laminated material of thermoplastic film, foam and fabric.

22 Claims, 10 Drawing Sheets

ADJUSTABLE AIR CUSHION INSOLE WITH ADDITIONAL UPPER CHAMBER

This application claims benefit of U.S. Provisional patent application Ser. No. 60/425,191 filed Nov. 7, 2002 by Nikola Lakic.

BACKGROUND OF THE INVENTION

1. Technical Field

This invention generally relates to an inflatable lining for footwear, and specifically to an inflatable inner sole with protective and comfortable coatings and surrounds and a method of manufacture.

2. State of the Art

Inner soles have been provided for shoes and boots which are formed of a compressible, elastic material such as cellular plastic foams, foam rubber, etc. These inner soles have provided only limited shock absorbency, resulting in little or no significant improvement in wearer comfort.

Some prior investigators have provided inner soles with inflated cushions at either the toe and heel areas, and some have provide cushions at both areas with circulation between the two cushions. The cushions have been provided with mechanisms to circulate air and ventilate the shoe or boot during walking activities. Examples of these are: U.K. Patents 2,189,679 and 357,391; U.S. Pat. Nos. 3,180,039, 2,716,293, 1,213,941 and German Patent 3,144,207.

Sport socks are also available for hikers and runners which have a double layer of fabric on the undersurface of the sock in an attempt to prevent formation of blisters on a user's foot.

In some foot apparel, notably in ski boots, an outer shell is molded from plastic and is lined with an inner shoe. Adjustment has been made to the tightness of the outer shell and air bags have been provided across the instep region of the shoe, and elsewhere, and have been provided with an air pump to pressurize the air bags, thus forcing the foot against the sole and creating a snugness of the fit of the ski boot. U.S. Pat. No. 4,730,403 and German Patent 2,321,817 are representative of these ski boots.

A water-filled inner sole for shoes has recently been marketed under the trade name "Walk On Water". While this is an attempt to increase wearer comfort, water is heavy, non-compressible and the inner sole cannot be adjusted for firmness, and cannot provide shock absorbency. Additionally, water is unsuited for use in freezing climates. Also, a leak will wet the inside of the footwear, and this inner sole is not breathable.

Also, recently marketed product, used by some podiatrists is a silicon fluid-filled inner sole. By pressing the insole with a wearers heel and forefoot, silicon fluid moves to the area of least resistance, which is the arch area. The problem with this product is that the podiatrists have to produce, and have handy, many of the same size insoles with different amounts of silicon inserted in order to satisfy a particular customer. Also silicon is heavy and is not compressible. Although, it provides some arch support it is at the expenses of cushioning at the rest of the foot area. For example, when pressed with a wearers heel, silicon is squeezed from a heel area towards an arch area and there is nothing to provide comfort for the wearers heel.

Another product is that disclosed in U.S. Pat. Nos. 4,183,156; 4,340,626 and 4,817,304 in which an inflatable inner sole or sole insert is permanently inflated with halogenated hydrocarbon gases. Since it is impossible to preclude diffusion of gases through the plastic, the inflatable insert or inner sole is acknowledged to experience a rapid increase in pressure shortly after manufacture, followed by a slowly declining pressure, thus failing to provide a stable condition. The pressure of the inflatable member also cannot be adjusted by the wearer for varying conditions of use and comfort.

In my prior patent (U.S. Pat. No. 5,846,063) I disclosed and claimed inflatable linings with an on board inflation pump and a relief valve which is readily adaptable to mass manufacturing techniques. A preferred application of the inflatable enclosure is that of an inflatable inner sole of footwear.

DISCLOSURE OF THE INVENTION

It is an objective of this invention to provide a light weight, shock-absorbing inflatable lining which enhances the fit, stability and comfort of footwear.

It is also an objective of this invention to provide the aforementioned inflatable lining with at least one on-board air pump and relief valve to permit the wearer to adjust the lining from firm to soft support, as desired for the wearer's weight and or activity.

It is an additional objective of this invention to provide an inflatable lining as an inner sole for footwear such as shoes, boots and sandals, having an arch pillow and a contour conforming to the wearer's foot, which preferably will massage the wearer's foot.

It is likewise an objective of this invention to provide an inflatable lining as an inner sole for orthopedic footwear to treat and prevent foot disorders. In this regard, it is an objective of this invention to provide adjustability by adding or removing fluid.

It is a further objective of this invention to provide an inflatable lining with a surface which will reduce blister formation. In order to achieve this aspect, one objective is to permit a minimal amount of lateral movement between an upper and an intermediate layer of the inflatable sole.

It is a further objective of this invention to provide the aforementioned inflatable linings with a fabric and/or a foam covering for comfort enhancement.

It is also an objective of this invention to provide a simple method for manufacture of the inflatable lining.

Other and related objectives will be apparent from the following description of the invention.

SUMMARY OF THE INVENTION

This invention comprises an inflatable lining or sole for footwear that meets the above objectives. To achieve these objectives, the inflatable sole has an inflatable inner sole with a built-in air pump and a relief valve and at least one additional upper chamber formed by heat sealing (welding) an additional outer layer on top of inflated inner sole. The outer layer may be bonded only to the edges of the inflatable enclosures to permit free air/fluid flow from pressure point area to the area of least resistance and greatest need. Air pressure of the lower chamber can be adjusted according wearers weight and activities. The upper chamber can also be provided with a built-in air pump and a relief valve, preferably with lesser air pressure that can be adjusted according wearers foot problems or for final comfort tuning. The outer layer can be a laminated material of thermoplastic film, foam and fabric. The inflatable linings are preferably similar to those described in my prior patent (U.S. Pat. No. 5,846,063) which includes an on-board air pump and a relief valve, and to my prior patent (U.S. Pat. No. 6,510,624), (both of which are incorporated herein by reference).

In a simple form, the present invention includes an inflatable inner sole for footwear that has an inflatable first enclosure formed of first and second sheets of plastic film bonded together by a continuous seam defining a peripheral flange surrounding a surface field and forming a sealed interior. The sealed interior may have a plurality of discontinuous seams extending across the surface field to form interconnecting, internal passageways within the sealed interior. The inflatable inner sole may also include a flexible cover sheet overlying the upper surface of the sealed first enclosure, said flexible cover sheet having an underlayer. The underlayer may be bonded about its periphery to the peripheral flange and unbonded to the field of the upper surface. Thus, the underlayer and the peripheral flange become a single homogenous material that cannot be distinguished into the first sheet, the second sheet, and the underlayer of which the material is formed. Furthermore, a second enclosure is formed adjacent to the first enclosure and a padding material may be disposed within the second enclosure for support and comfort to the user. A pump may be fluidly connected with said sealed interior of the first enclosure so that the first enclosure may have a first chamber selectively inflated under pressure and the second enclosure may form a second chamber at substantially atmospheric pressure for enhanced comfort.

Additional aspects may include the cover sheet provided as a laminate of fabric and the underlayer with the underlayer including a plastic material. The padding material may include an overlay sheet lying between the cover sheet and the first enclosure and spanning across the field of the inflatable enclosure. Alternatively, the padding material may be sized and positioned to cover only an arch portion of the inner sole. The flexible cover sheet may include a flexible synthetic thermoplastic.

The inflatable inner sole may include discontinuous seams in an arch area of the inner sole which form a medial recess for receiving a pump. These discontinuous seams also providing an arch pillow as an additional arch support in the inner sole. The inflatable inner sole may include the pump that is an air pump mounted in the medial recess and including a flexible bulb with a valve inlet port having an inlet check valve and a valve outlet port having an outlet check valve. The pump may further include an air pump housing located in the recess with the check valves mounted in the housing and also including a normally closed pressure relief valve having a valve operator accessible in the recess to release air from the sealed interior. Furthermore, the inflatable inner sole may further include an additional pump fluidly connected to the second enclosure.

In another simple aspect, the inflatable inner sole may include an upper portion, an intermediate portion, and a lower portion. The upper portion, the intermediate portion, and the lower portion may be connected to each other to form substantially a first air tight enclosure between the intermediate portion and the lower portion and a second air tight enclosure between the upper portion and the intermediate portion. A first pump may be fluidly connected to the first enclosure for selectively adjusting a gas pressure within the first enclosure. A second pump may be fluidly connected to the second enclosure.

As before, a padding material may disposed in the second enclosure between the upper portion and the intermediate portion for added support and comfort. The padding material may be disposed in an arch portion or other portions of the inner sole. The padding material may be provided in a substantially entirely overlapping relation relative to the inner sole. The padding material may include a foam material, a semi-rigid material, a resilient material that provides a spring effect to a user of the inner sole, and/or a gel that forms a custom arch support when pressed under a weight of a user. In this aspect, the padding material may be defined as including both gel and a gas.

It should also be noted that a lubricant may be provided in the second enclosure to facilitate sliding movement between the upper portion and the intermediate portion in order to reduce formation of blisters on the user's foot. While reaching this objective may benefit others, it is contemplated that doing so will most greatly benefit more aggressive users such as marathon runners, for example.

The foregoing and other features and advantages of the present invention will be apparent from the following more detailed description of the particular embodiments of the invention, as illustrated in the accompanying drawings.

BRIEF DESCRIPTION OF THE DRAWINGS

The invention will be described with reference to the figures of which.

DETAILED DESCRIPTION OF THE INVENTION

Figure 1:
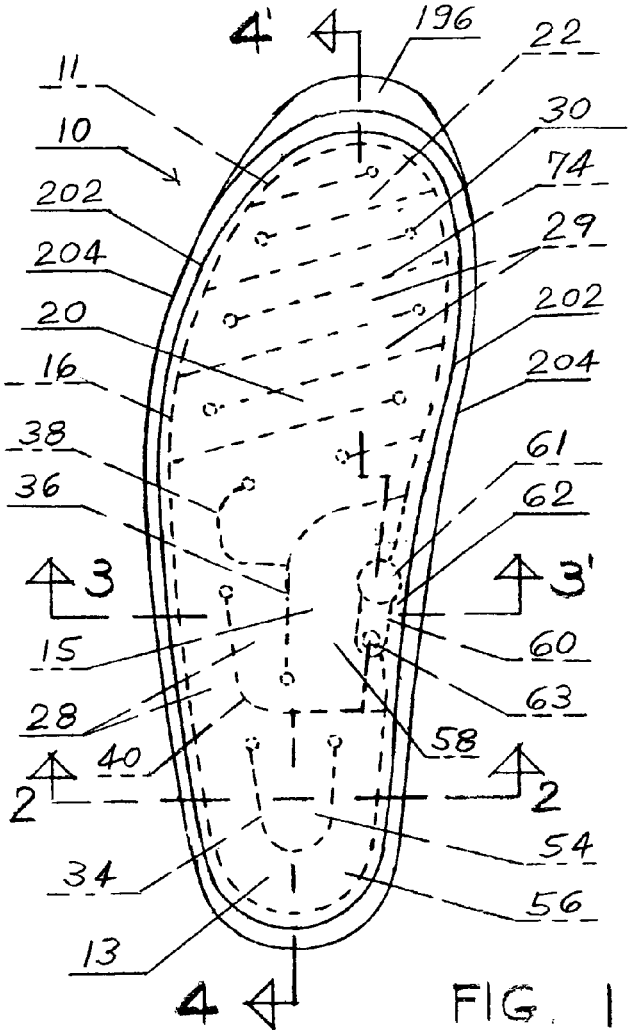
FIG. 1 is a plan view of an inflatable inner sole with a lower and an upper chamber with an on-board air pump and an adjustable relief valve.
Figure 4:
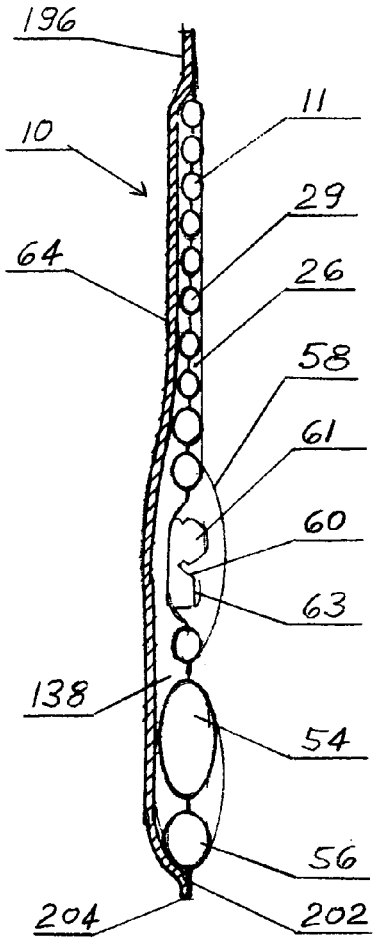
FIG. 4 is a cross sectional view along line 4–4' of the inner sole of FIG. 1.
Figure 3:
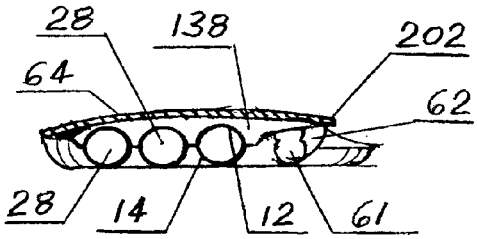
FIG. 3 is a cross sectional view along line 3–3' of the inner sole of FIG. 1.
Figure 2:
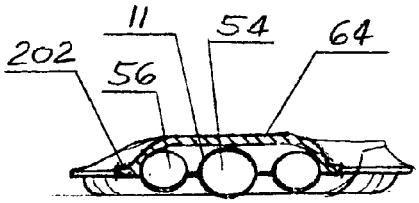
FIG. 2 is a cross sectional view along line 2–2' of the inner sole of FIG. 1.
Figure 5:
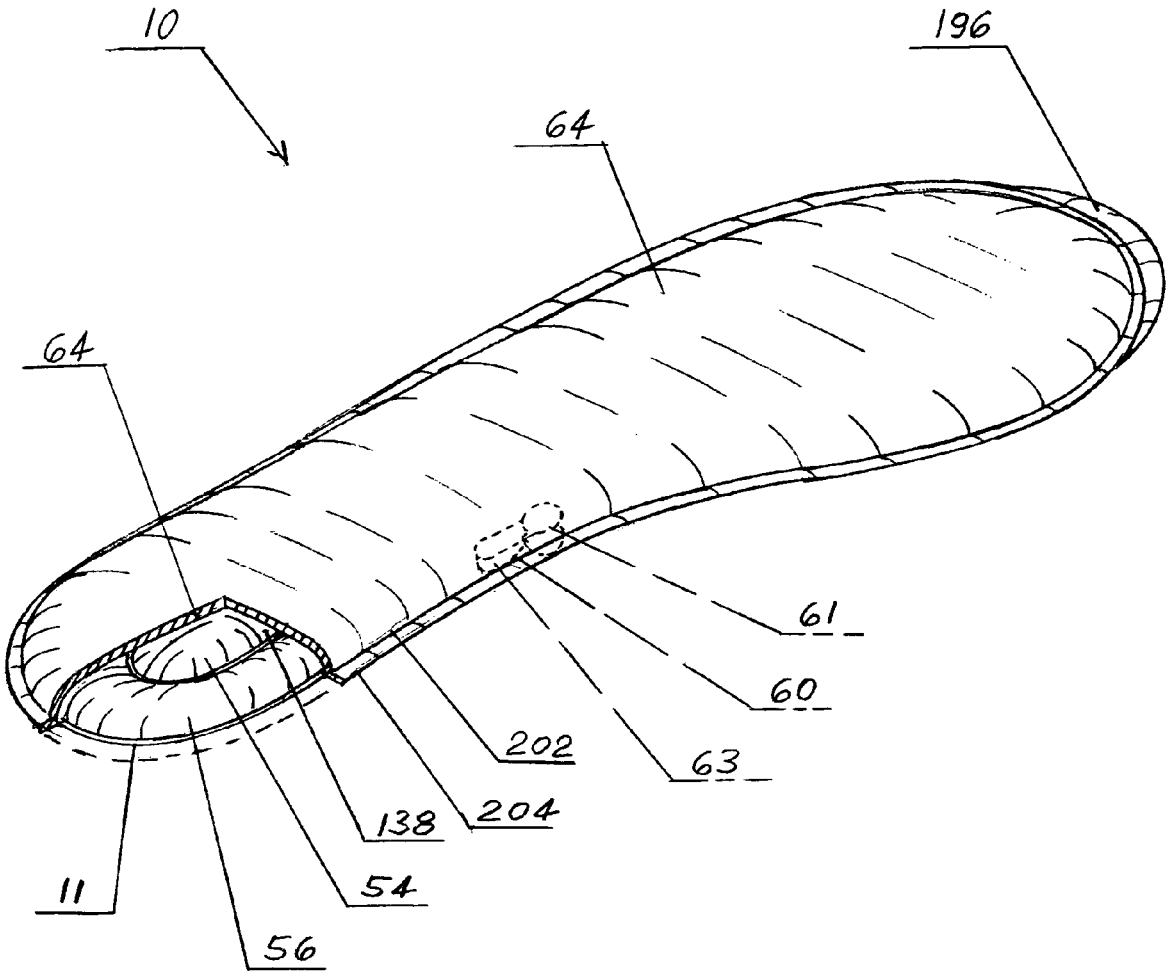
FIG. 5 is a perspective view of the inflatable inner sole of FIG. 1.

Referring now to FIGS. 1–5, the invention as applied to an inflatable inner sole will be described. The inflatable inner sole 10 is shown in a plan view in FIG. 1, in sectional views in FIGS. 2–4, in perspective, partial sectional view in FIG. 5 and in an enlarged sectional view in FIG. 12. The inflatable inner sole 10 which has an inflatable enclosure 11 that extends across the entire sole including the heel area 13, the arch or instep area 15, the toe area 22 and metatarsal area 20. The inflatable enclosure 11 is formed by a first sheet 12 and a coextensive second sheet 14 of substantially the same shape and size. These sheets can be best seen in the enlarged sectional view of FIG. 12. The first and second sheets (films) 12 and 14 are bonded together in a continuous peripheral seam 16 that extends about the heel area 13, the instep area 15 and toe area 22 of the inner sole 10.

The first and second sheets (films) 12 and 14 are plastic, and may be thermoplastic, so that conventional heat sealing can be used for forming the seams. The thermoplastic material may be polyurethane. However, other suitable materials include ethylene, and ethylene vinyl acetate copolymers, polyethylene, polypropylene, polyvinyl chloride, etc.

The first sheet 12 and the second sheet 14 are also bonded together with a plurality of discontinuous seams 34, 36, 38 and 40 which form tubular, interconnecting passageways 56 through the heel area 13 and passageways 28 through the instep area 15 of the inner sole 10. The inflatable enclosure 11 also has a plurality of discontinuous, transverse seams 74 in the metatarsal area 20 and toe area 22 to impart flexibility to the inner sole 10 and to form interconnecting passageways 29 which extend across these areas to permit the wearer to control the firmness and support of the inner sole simply by controlling the inflation pressure within the inflatable enclosure 11.

The spacing between adjacent seams controls the size or diameter of the passageways 28 and 29. If desired, some areas of the inflatable enclosure 11 can be unseamed to form air pillows. The size and spacing of the interconnecting passageways and pillows can easily be varied during manufacture to adapt the inner sole to the particular shoe. Thus, the pillows and passageways in the arch area can be small in size to fit conventional shoes with integral arch supports or large in size for use with shoes having flat or nearly flat soles to provide an arch support. In either case, the firmness of the inner sole 10 can be regulated by adjustment of the air pressure within the inflatable enclosure 11.

There are also circular or closed loop seams 30 to provide end points of the internal seams. These closed loop seams 30 may encircle through openings that extend entirely thorough the first and second sheets 12 and 14. The closed loop seams 30 provide ends for the discontinuous or internal seams, which ends are rounded and thus tend away from failure of the material near the ends of the seams. The spacing, size and number of the discontinuous seams can be varied greatly, as desired, to provide the maximum comfort and convenience to the wearer of a shoe fitted with the inflatable inner sole 10.

The C-shaped heel seam 34 forms a heel pillow 54 and a heel peripheral tubular passageway 56. There is a small C-shaped arch pillow 58 which is formed by seams 16, 36 and 40 and which forms a medial recess 62 that receives the inflation assembly 60 which includes an air pump 61 and relief valve 63. The inflatable inner sole 10 in one embodiment is intended for use as a replacement insert for shoes which have some arch support. Therefore in this embodiment of the inner sole 10 a small arch pillow 58 is sufficient to encircle the pump and relief valve assembly 60. Alternatively, the arch pillow could be made larger for use of the inner sole with shoes having smaller existing arch supports.

In addition to the inflatable enclosure 11, the inflatable insole 10 has an additional chamber 138 formed on top of inflated enclosure 11 by heat sealing or welding outer layer 64 to the inflatable enclosure 11. To this end, the outer layer 64 may be heat sealed only to the edges of the inflatable enclosure, thus forming peripheral seams 202 and 204. Outer layer 64 may be a laminated material of thermoplastic film, foam, and fabric. An acceptable material for the outer layer 64 may be any of a variety of medium to high density urethane foams, examples of which are marketed under the trademark "HyPUR-cel", produced by the company, Rubberlite of Huntington, W. Va. Outer layer 64 may be heat sealed to the inflatable enclosure 11 after enclosure 11 is inflated so that a certain amount of air is captured inside newly formed chamber 138. In this assembly, air pressure inside upper chamber 138 is atmospheric. When a wearers heel and/or forefoot apply pressure on insole the air from pressed area will move to the area of least resistance and greatest need, and provide additional support for the user's arch. The air pressure of the lower chamber can be adjusted according to a wearers weight and activities and the air inside upper chamber can provide additional comfort and/or support. The compressibility of the outer layer 64 can be selected to provide a suitably soft and comfortable feel to the inner sole 10 and the firmness and shock absorbency of the inner sole 10 can thus be controlled by the inflation pressure which is maintained in the inflatable enclosure 11.

The upper or wear surface of the outer layer 64 is covered with fabric material 153. The fabric may be Nylon such as widely used in inflatables produced by Mann Industries, Inc., of Framingham, Mass., or material produced by Faytex Corp., Weymouth, Mass., like DRILEX® LINING, HYDROFIL® Nylon from Allied Signal. The moisture absorbing qualities of the HYDROFIL Nylon draws moisture away from the skin keeping the user dry, cool and comfortable. Also, insole 10 may have a non-inflated toe area 196 to be cut off if needed to fit in footwear of smaller shoe size. The under surface of the inflatable enclosure 11 rests on the inside wall of the sole of the footwear, forming open channels 26 beneath the enclosure 11. In reference to other illustrations of the invention, the components of this inner sole 10 which are similar to those previously described are identified with the same numerals as used in FIGS. 1–5.

FIGS. 6–10 illustrate an alternative inflatable inner sole 18. This embodiment is quite similar to that shown in FIGS. 1–5. However, the upper chamber 138 in this embodiment has its own pump 101 and relief valve 89. The air pressure in upper chamber 138 is preferably lower than air pressure in lower chamber 11. By having an additional pump and relief valve connected to the upper chamber 138, the wearer is able to air that has been lost after a certain period of time. Furthermore, a podiatrist will be able to add precise amount of air according a patient's needs at that time. Still further, the amount of air and pressure may be changed during the treatment period as needed.

If providing an alternative of a higher air pressure inside upper chamber 138 is desired, some of the internal discontinuous seams of enclosure 11 could be partially or completely extended through upper chamber 138. These seams would be similar to those between layers 12 and 14. However these seems would now include the outer or third top layer 64. The seams between layer 12 and layer 64 could selectively be provided to extend any desired distance.

Figure 11:
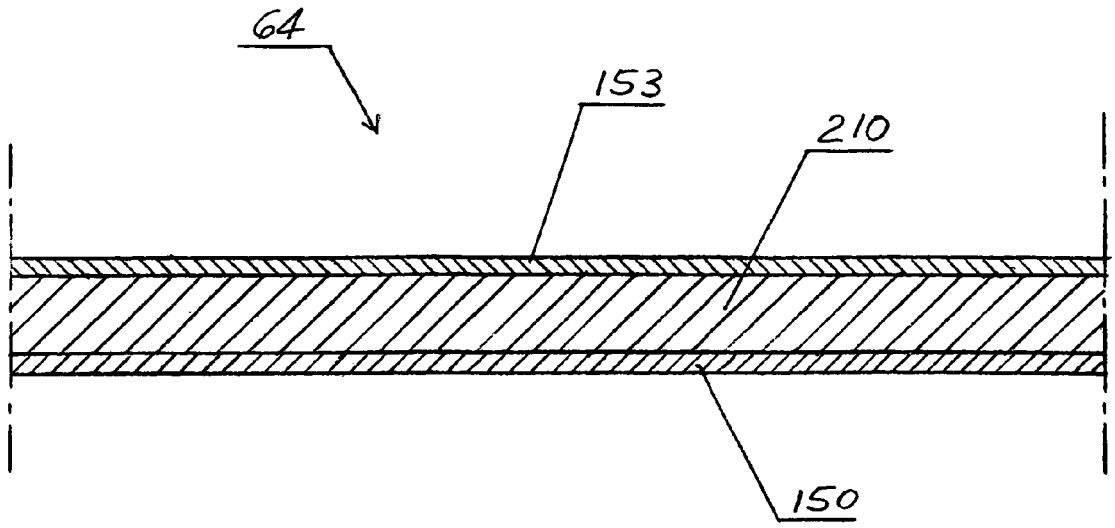
FIG. 11 is an enlarged cross sectional view of an outer layer.

FIG. 11 is an enlarge cross sectional view of outer layer 64, which is used to form upper chamber 138. Outer layer 64 is laminated with thermoplastic film 150 on a bottom, thermoplastic foam 210 in a middle and fabric 153 on a top. Thermoplastic film 150 provides reinforcement for thermoplastic foam 210 at a zone where stretching and/or bending forces are present. Thus, thermoplastic film 150 inhibits formation of the cracks on the outer layer 64, and especially at areas above seams on the enclosure 11. This is because the seams form recesses in the underlying field contour and the recesses tend to induce cracking over time when the outer layer 64 is not properly reinforced.

Inflatable Insole is produced by an electronic heat sealing process. Electronic sealing is accomplished by sending a high frequency or heating current through two or more layers of thermoplastic material placed between two sealing electrodes or dies. One die is shaped in the image of the required seal.

Figure 12:
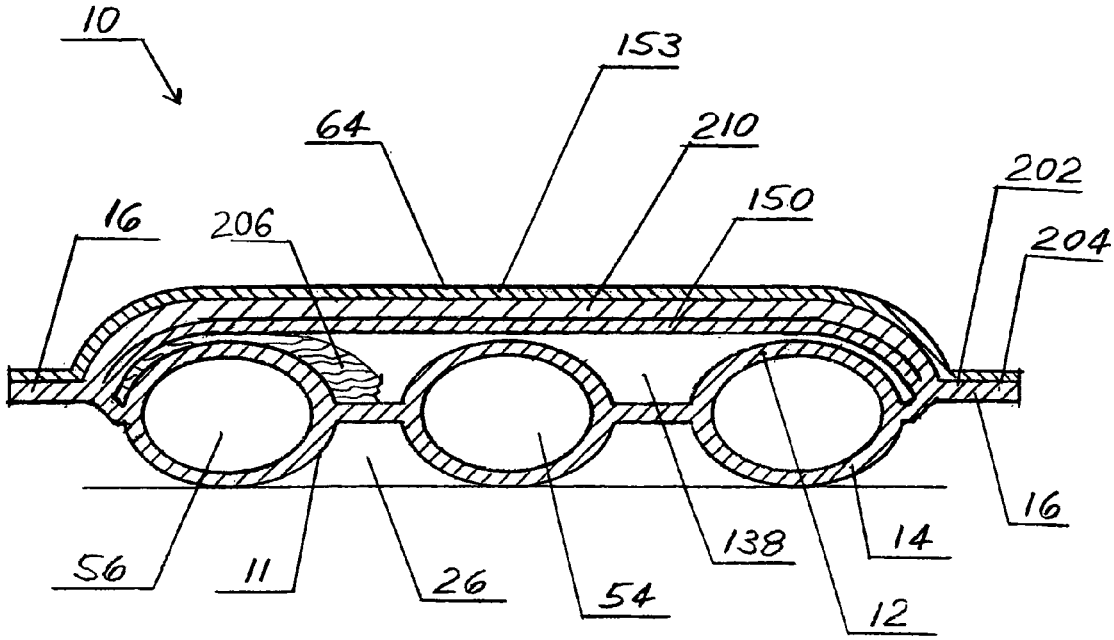
FIG. 12 is an enlarged sectional view of a portion of FIGS. 2 and 7 to illustrate the construction of the inflatable lining of the inner sole.

FIG. 12 illustrates a typical cross sectional view of an inner sole 10 or 18. This inflatable inner sole is formed by placing the outer layer 64 over inflatable enclosure 11, in an inflated state, and heat sealing the outer layer 64 to the enclosure 11 with double peripheral seams 202 and 204. The outer layer may be bonded only at the edges of the inflatable enclosures to permit free air/fluid flow from pressure points area to the area of least resistance and greatest need. This arrangement also permits relative movement between an upper cover 64 and the inflatable enclosure 11, which reduces chances of blister formation on a user's foot. If desired, a minor amount of a lubricant can be inserted in the chamber 138 to reduce frictional resistance between the cover 64 and field surface of the enclosure 11.

Also, as an alternative, fluid or gel 206, such as silicon with any of a variety of selected densities and viscosities can be inserted into upper chamber 138 to provide an additional arch support. As shown by the breakaway line in FIG. 12, the fluid 206 is an alternative to air or other gases. As such, the entire enclosure may be filled with the gel 206. Further alternatively, the enclosure 138 may be partially filled with a gas and partially filled with gel 206 as shown in FIG. 12. In any case, the fluid or gel 206 may have a viscosity that stays in a particular shape into which it is formed. Thus, the gel 206 may be pressed into the arch area, for example, under pressure from a user's foot and remain there to form a custom arch support that is unique to the user. In this way, the inner sole also provides a dynamic arch support that may change as the user's foot squeezes the gel with greater or lesser pressure from the heal and forefoot of the user, for example.

The inner sole of the present invention may have an inflatable enclosure 11 which is inflated under pressure and another upper air chamber 138 at a lesser pressure for enhanced comfort and arch support. This inflation may be incorporated with or without gel 206 or other fluids. In any case, the bulk and weight of the inner sole may be kept more or less small.

Figure 6:
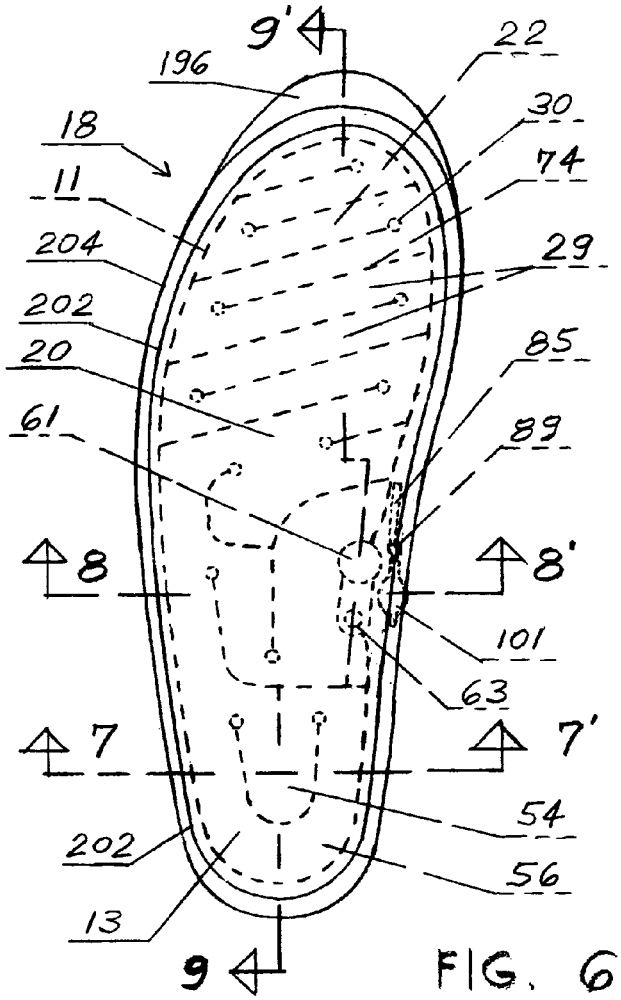
FIG. 6 is a plan view of an alternative inner sole also with a lower and an upper chamber with two on-board air pumps and two adjustable relief valves.
Figure 9:
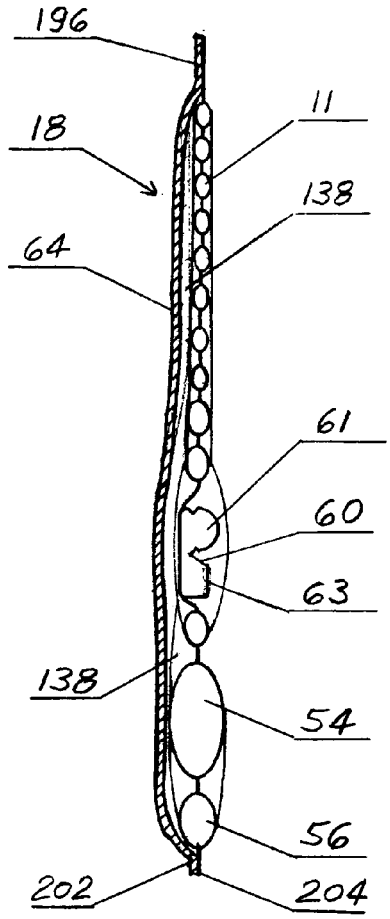
FIG. 9 is a cross sectional view along line 9–9' of the inner sole of FIG. 6.
Figure 8:
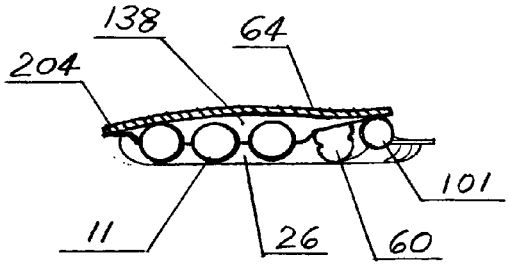
FIG. 8 is a cross sectional view along line 8–8' of the inner sole of FIG. 6.
Figure 7:
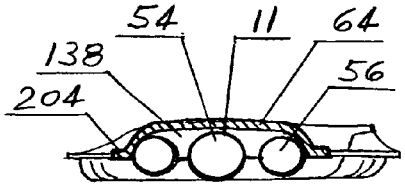
FIG. 7 is a cross sectional view along line 7–7' of the inner sole of FIG. 6.
Figure 10:
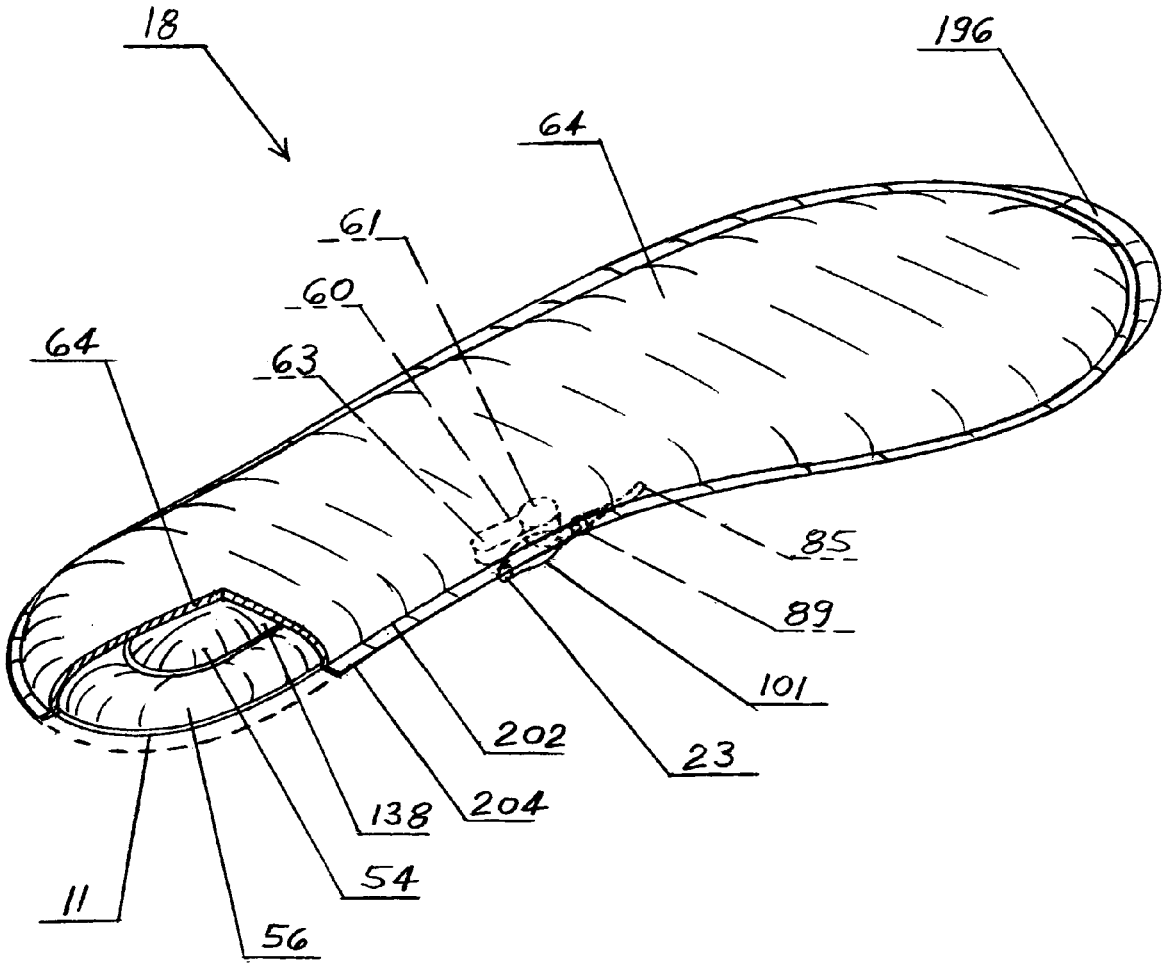
FIG. 10 is a perspective view of the inflatable inner sole of FIG. 6.
Figure 13:
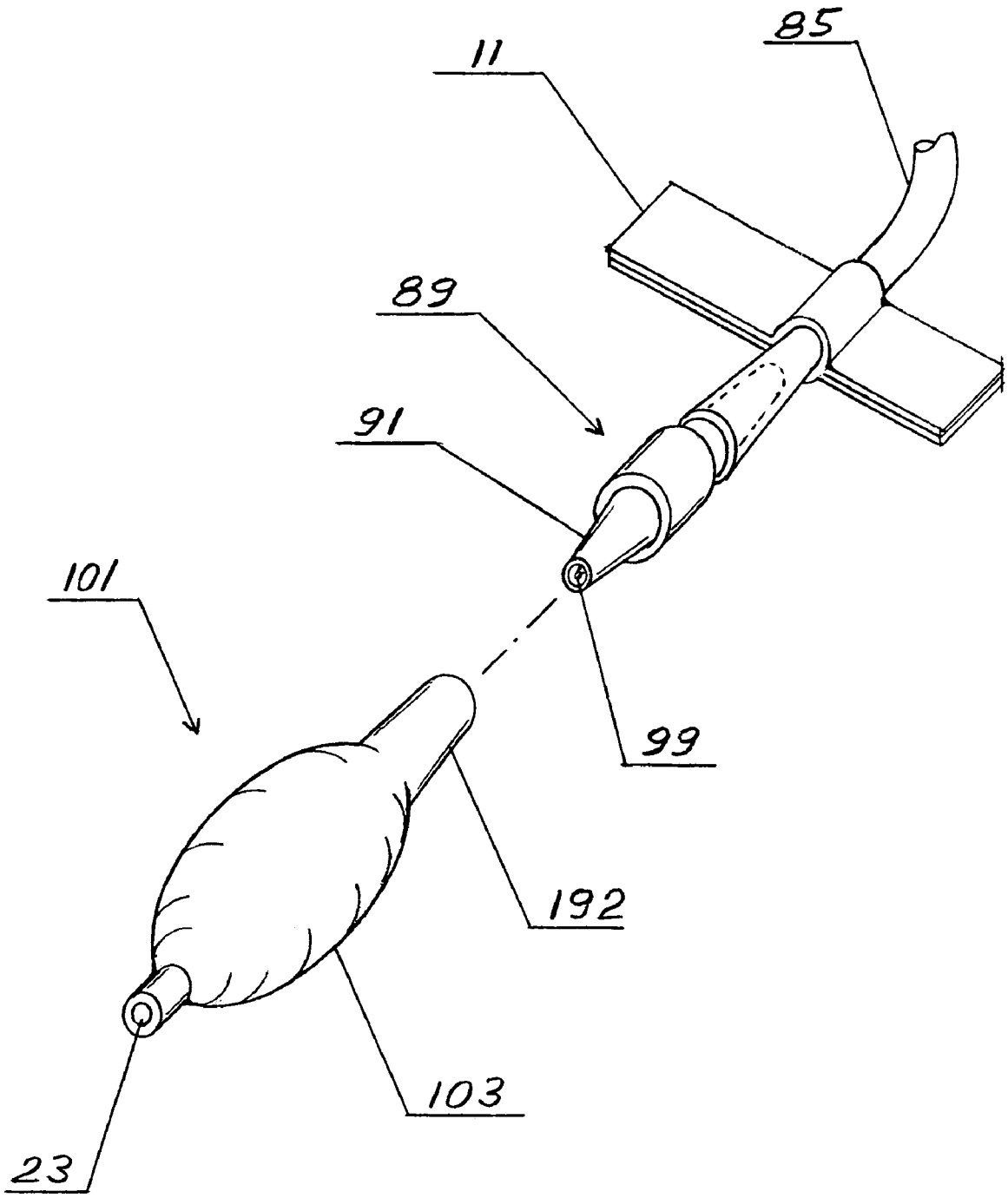
FIG. 13 is an enlarged perspective view of the air pump and relief valve assembly illustrated in FIGS. 6 and 8.
Figure 15:
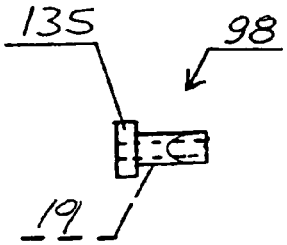
FIG. 15 is a view of a check valve used in the air pump and check valve assembly.
Figure 16:
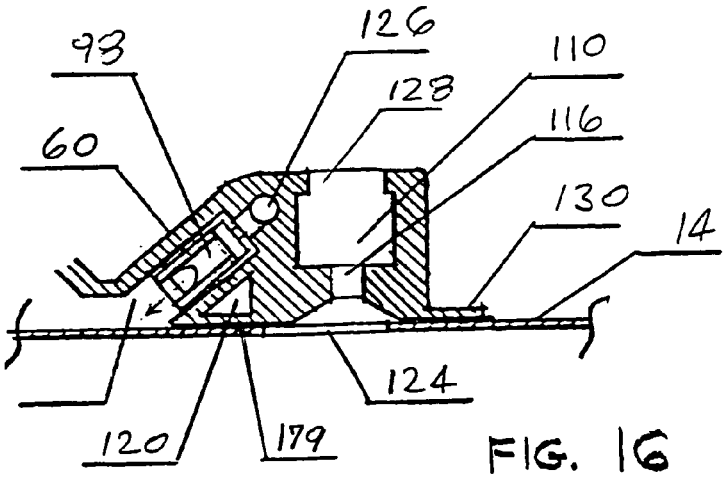
FIG. 16 is a sectional view along line 16–16' of FIG. 14, with the relief valve omitted.
Figure 14:
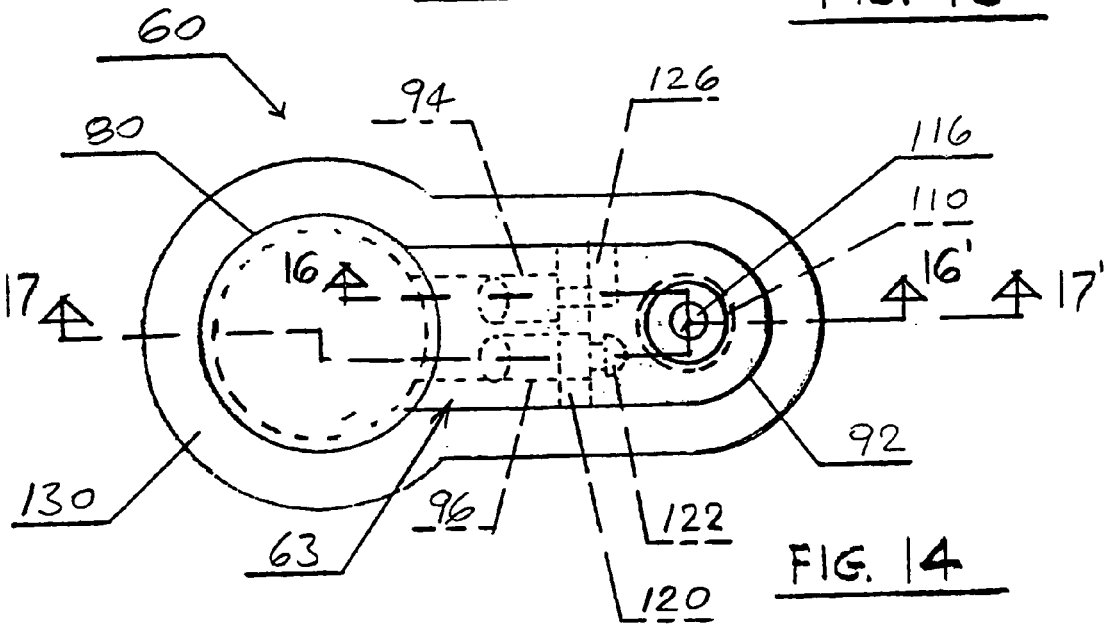
FIG. 14 is a plan view of the air pump and check valve assembly used with the inflatable linings.
Figure 17:
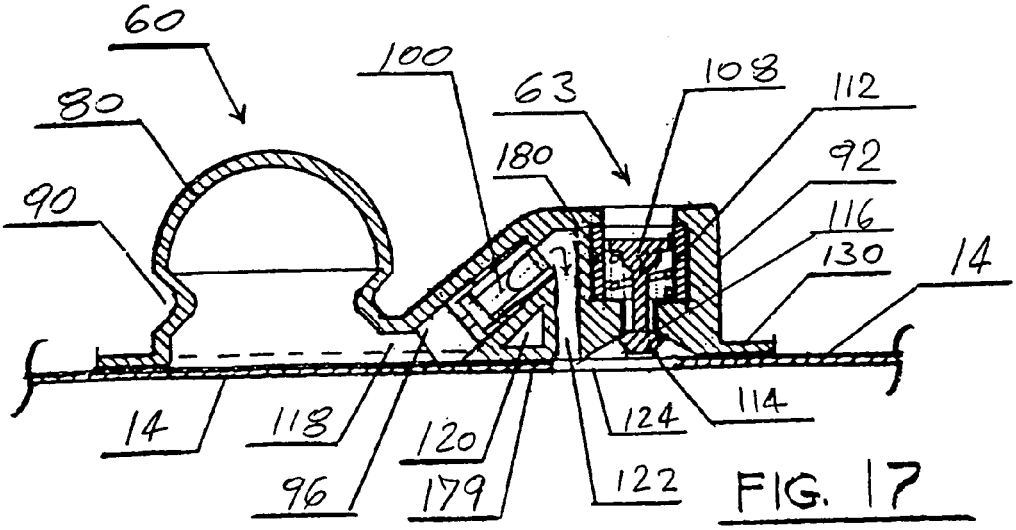
FIG. 17 is a sectional view along line 17–17' of FIG. 14.

FIG. 13 is an enlarged perspective view of the air pump 101 and connector with relief valve 89 of FIG. 6. A flexible bulb 103 has an inlet check valve 23 inserted into one end of flexible bulb 103. The opposite end of the flexible bulb has a port 192 which slides on outer neck 91 of connector assembly 84 which contains a relief valve 89 that is shown in greater detail in FIG. 19. The flexible bulb 103 is easily removable and needs to be removed in order for relief valve 89 to be used to release air from upper chamber 138. Outer neck 91 can have external threads which are threadably received within port 192 for better fit and faster removal of the pump 101.

Figure 18:
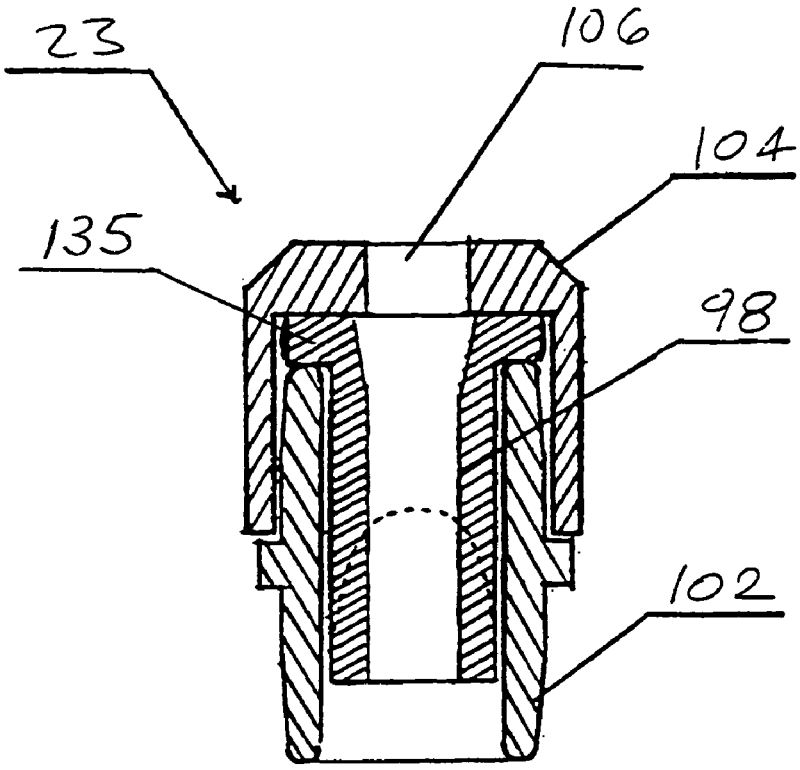
FIG. 18 is a view of a check valve assembly useful in the air pump and relief valve assembly.

FIGS. 14 through 17 are plan and sectional views of the pump and relief valve assembly 60 which permits the wearer to adjust the inflation pressure within the inflatable enclosure 11 to any desired comfort level or support. The construction and operation of this assembly is described in my prior patent (U.S. Pat. No. 5,846,063). The assembly 60 includes a compressible pump dome 80 which has an undercut 90 for ease of depression. The housing 92 of the assembly 60 has two cavities 94 and 96 which receive two duck-bill check valves (also shown in FIG. 15), inlet check valve 98, and outlet (discharge) check valve 100. An enlarged cross-sectional view of a subassembly 23 of the check valves is shown in FIG. 18. Prior to insertion into the housing cavities 94 and 96, each of the duck-bill check valves 98 and 100 are inserted into a protective brass sleeve 102 and brass cup 104 which has an opening 106 for air passage. Each valve is captured in the assembly with its flange 135 locked between the sleeve 103 and cup 104. The assembly is then inserted into cavities 94 and 96 of the pump housing 92 illustrated in FIGS. 14, 16 and 17. As the housing 92 is formed of soft plastic, the protective sleeves 102 and cups 104 prevent accidental squeezing of the check valves when forces are applied to the housing 92.

A relief valve operator 108 is inserted into a valve cavity 110 of the relief valve housing 92 and a coil spring 112 is positioned beneath the operator 108 to provide a biased force which seats the seal ball 114 on the lower end of the relief valve operator 108 to seat against the valve aperture 116. There is a passageway 118, which connects the cavity beneath dome 80 and check valve 100. The outlet passage from check valve 100 extends over tunnel 120, through passageway 122 and through opening 124 on the first flexible plastic sheet 12 into the inflatable enclosure. The tunnel 120 accepts a mandrel (metal bar) which is a removable part of the metal sealing die to heat seal the area 179, beneath tunnel 120, to form a sealed cavity beneath the dome 80. Thus, resulting structure provides air circulation only through check valves 98 and 100. The inlet check valve 98 receives air through side opening 126 and discharges air into the cavity beneath pump dome 80. There is a recess 128 on a top surface of the relief valve housing 92 to prevent accidental activation of the relief valve operator 108 when in contact with an existing shoe lining. An aluminum sleeve 180 may be additionally or alternatively inserted inside cavity 110 to reinforce housing 92 to prevent accidental squeezing and activation of the relief valve.

There is a flange 130 around the assembly 60 to permit permanent attachment of the assembly to a supporting surface, (usually a plastic sheet or film), by heat sealing or any other alternative process.

FIG. 18 is a sectional view of a check valve assembly 23 used in the air pump and relief valve assembly 60 and in the pump 101. The duck bill valve 98 may be inserted inside brass sleeve 102 and than encapsulated with brass cup 104, which has an opening 106 through which air can circulate.

Figure 19:
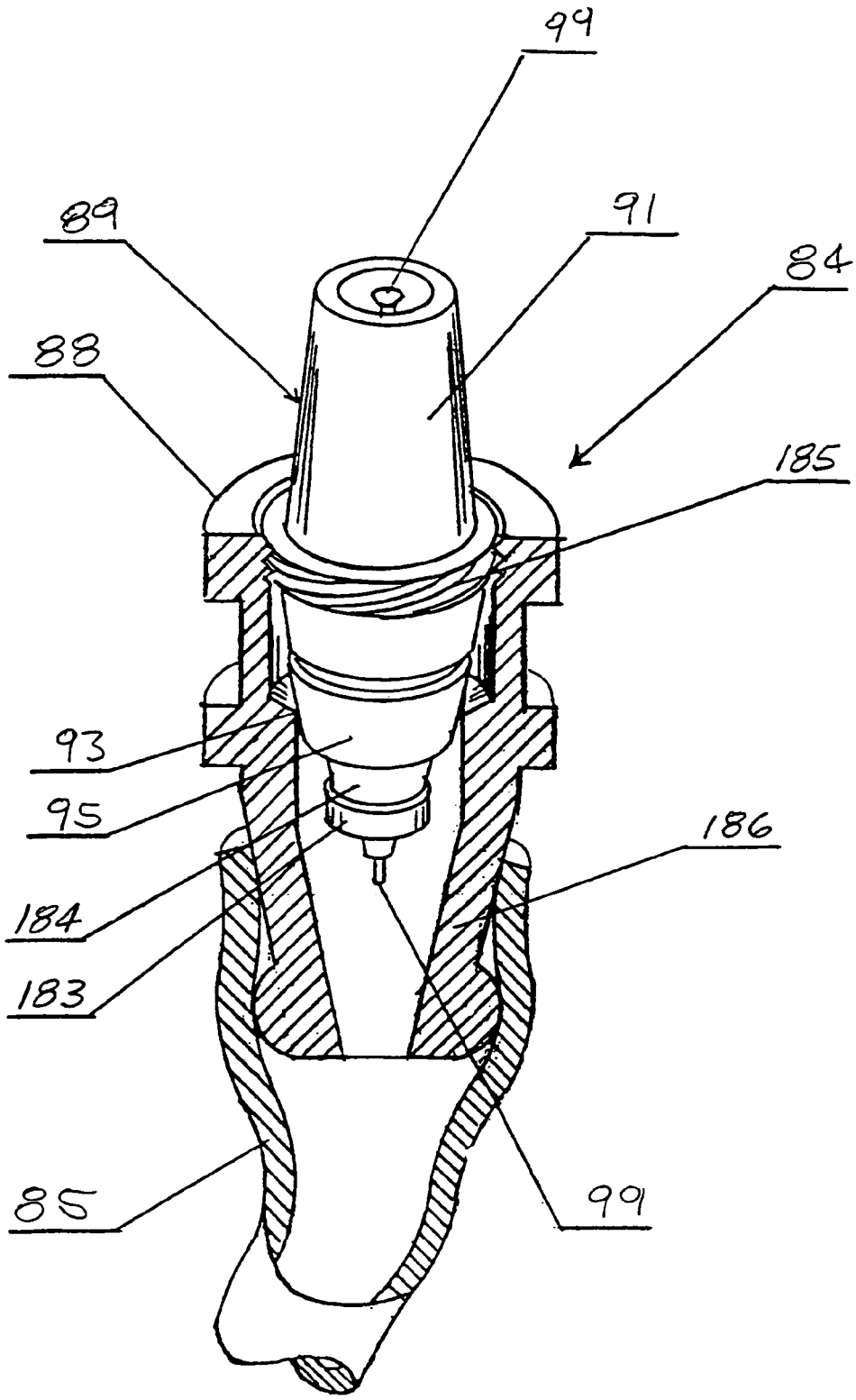
FIG. 19 is a sectional view of the relief valve and connector illustrated in FIGS. 6–10 and 13.
Figure 20:
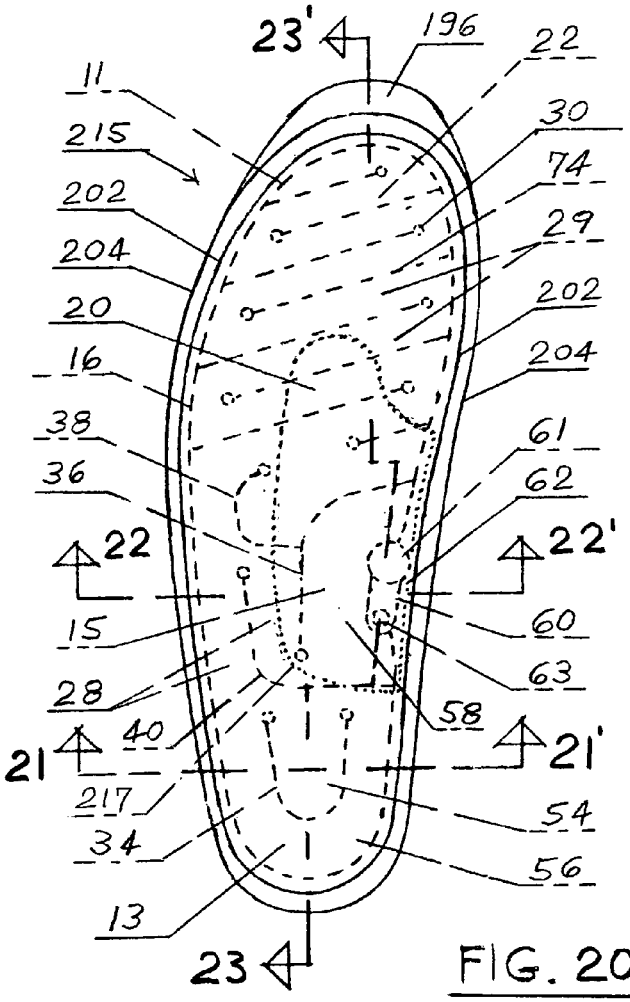
FIG. 20 is a plan view of an alternative inner sole also having a lower and an upper chamber with an on board air pump and an adjustable relief valve.
Figure 23:
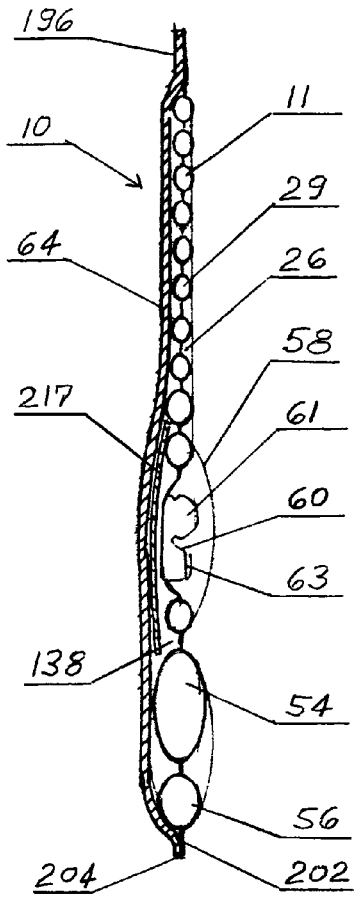
FIG. 23 is a cross sectional view along line 23–23' of the inner sole of FIG. 20.
Figure 22:
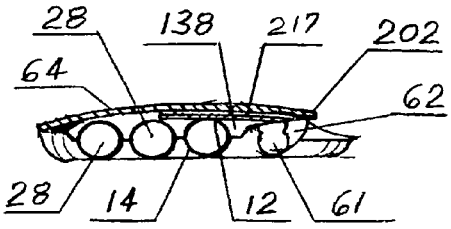
FIG. 22 is a cross sectional view along line 22–22' of the inner sole of FIG. 20.
Figure 21:
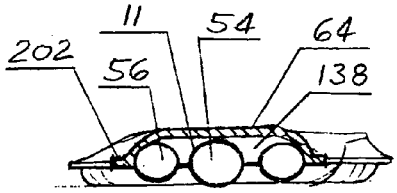
FIG. 21 is a cross sectional view along line 21–21' of the inner sole of FIG. 20.

FIG. 19 is a sectional view of the connector/valve assembly 84. The connector/valve assembly 84 is an conventional inflation valve similar to valves available from Schrader Automotive Inc., Nashville, Tenn. 37202. This valve 89 has a valve member 183 which is resiliently biased into a closed position against the valve seat 184 by an internal spring (not shown). The valve member 183 is secured to a rod 99 which extends through the valve to an upper end 99 which serves as a valve operator to permit opening of the valve. The valve 89 has external threads which are threadably received within a connector housing 88. The upper end of the neck 91 of the valve 89 is conical to permit removable attachment of the pump 101 illustrated in FIG. 13. The lower end of valve 89 has a rubber ring 95 which seats against internal shoulder 93 of the housing 88 for resilient sealing within the connector housing. The connector housing has a conical connector leg 186 to receive a tubing such as tube 85.

FIGS. 20–23 illustrate an alternative inflatable inner sole 215. The embodiment of FIGS. 20–23 is quite similar to those of FIGS. 1–5 and 6–10. However, the embodiment of FIGS. 20–23 has an additional spongy/foam padding material 217 inserted inside the upper chamber 138. The padding material 217 is positioned between the lower chamber 11 and the outer layer 64 and provides an additional arch support. This additional arch support provides needed support in case air is lost from the upper chamber 138 as may occur over an extended period of time.

The padding material 217 shown in FIGS. 20–23 may be incorporated with any of the other embodiments of the present invention. In particular, with the embodiment of FIGS. 6–10, the padding material 217 provides the option of deflating the upper chamber so that padding and support in the upper chamber for a user's foot is provided substantially by the padding material. The padding material 217 may alternatively or additionally include other materials such as graphite or other composites, which may have flexible, semi-rigid, and/or rigid characteristics. This padding material 217 may be sized and positioned only in the arch area or may be sized and positioned to overlap and cover any or all of the entire sole without departing from the spirit and scope of the present invention. In one aspect the padding material 217 may provide a resiliency that in turn provides a spring effect to the user of the inner sole. The padding material may be made to have smooth edges and may have a contour that will not penetrate adjacent surfaces. This may be accomplished by bending edges of the material and/or providing special coatings, for example.

It is contemplated that the general structure shown throughout the figures may be formed in other manners than those specifically set forth above. For example, upper and lower complimentary parts could be molded or otherwise prefabricated to form a generally clam shell arrangement that does not require inflation to assume the shape, size, and contour shown in the Figures. The upper and lower molded parts could be bonded together at the peripheries and/or elsewhere to sealingly form at least one enclosure between the parts. The bond may be provided by fusing or heat sealing. Thus, such an arrangement could be made to receive air or other gas in enclosures within and/or between the complimentary parts. In this way, the firmness and other support and comfort characteristics may be adjusted by adding or removing air or other fluid. As set forth above, air, gel, or a combination of air and gel may be used to fill or partially fill the enclosures.

The invention has been described with reference to the illustrated and presently preferred embodiment. It is not intended that the invention be unduly limited by this disclosure of the preferred embodiment but instead by the elements and their equivalents set forth in the claims that will follow.

I claim:

1. An inflatable inner sole for footwear which comprises:

a. an inflatable first enclosure formed of first and second sheets of plastic film bonded together by a continuous seam defining a peripheral flange surrounding a surface field and forming a sealed interior, with a plurality of discontinuous seams extending across said field to form interconnecting, internal passageways within the sealed interior;

b. a flexible cover sheet overlying the upper surface of the sealed first enclosure, said flexible cover sheet comprising an underlayer, said underlayer bonded about its periphery to the peripheral flange and unbonded to the field of said upper surface, wherein said underlayer and said peripheral flange become a single homogenous material that cannot be distinguished into said first sheet, said second sheet, and said underlayer of which said material is formed, and wherein a second enclosure is formed adjacent to said first enclosure;

c. a padding material disposed within the second enclosure for support and comfort;

d. a pump fluidly connected with said sealed interior; and wherein said first enclosure has a first chamber selectively inflated under pressure and said second enclosure forms a second chamber at substantially atmospheric pressure for enhanced comfort.

2. The inflatable inner sole of claim 1 wherein said cover sheet is a laminate of fabric and said underlayer, wherein said underlayer comprises a plastic material.

3. The inflatable inner sole of claim 1 wherein the padding material comprises an overlay sheet lying between said cover sheet and said first enclosure and spanning across said field of said inflatable enclosure.

4. The inflatable inner sole of claim 1 wherein said inner sole has a shape to extend over the heel and metatarsal area of said footwear.

5. The inflatable inner sole of claim 1 wherein said flexible cover sheet comprises a flexible synthetic thermoplastic.

6. The inflatable inner sole of claim 1 including discontinuous seams in an arch area of said inner sole which form a medial recess for receiving the pump and forming an arch pillow for an additional arch support in said inner sole.

7. The inflatable inner sole of claim 6 wherein the pump comprises an air pump mounted in said medial recess and comprising a flexible bulb with a valve inlet port having an inlet check valve and a valve outlet port having an outlet check valve.

8. The inflatable inner sole of claim 7 wherein the pump further comprises an air pump housing located in said recess with said check valves mounted in said housing and also comprising a normally closed pressure relief valve having a valve operator accessible in said recess to release air from said sealed interior.

9. The inflatable inner sole of claim 1, further comprising an additional pump fluidly connected to the second enclosure.

10. The inflatable inner sole of claim 1, wherein the padding material is sized and positioned to cover only an arch portion of the inner sole.

11. An inflatable inner sole for footwear, the inner sole comprising:

an upper portion;

an intermediate portion; and a lower portion;

the upper portion, the intermediate portion, and the lower portion connected to each other to form substantially a first air tight enclosure between the intermediate portion and the lower portion and a second air tight enclosure between the upper portion and the intermediate portion; and a first pump fluidly connected to the first enclosure for selectively adjusting a gas pressure within the first enclosure.

12. The inflatable inner sole of claim 11, further comprising a second pump fluidly connected to the second enclosure.

13. The inflatable inner sole of claim 11, further comprising a padding material disposed in the second enclosure between the upper portion and the intermediate portion for added support and comfort.

14. The inflatable inner sole of claim 13, wherein the padding material is disposed in an arch portion of the inner sole.

15. The inflatable inner sole of claim 13, wherein the padding material is provided in a substantially entirely overlapping relation relative to the inner sole.

16. The inflatable inner sole of claim 13, wherein the padding material comprises a foam material.

17. The inflatable inner sole of claim 13, wherein the padding material comprises a semi-rigid material.

18. The inflatable inner sole of claim 13, wherein the padding material comprises a resilient material that provides a spring effect to a user of the inner sole.

19. The inflatable inner sole of claim 13, wherein the padding material comprises a gel that forms a custom arch support when pressed under a weight of a user.

20. The inflatable inner sole of claim 13, wherein the padding material comprises gel and a gas.

21. The inflatable inner sole of claim 11, further comprising a lubricant in the second enclosure to facilitate sliding movement between the upper portion and the intermediate portion in order to reduce formation of blisters.

22. The inflatable inner sole of claim 11, wherein the upper portion comprises a thermoplastic foam layer and a thermoplastic film layer, wherein the thermoplastic film layer reinforces the foam layer and inhibits cracking in the upper portion.

* * * * *